United States Patent [19]

Koike

[11] Patent Number: 4,832,282

[45] Date of Patent: May 23, 1989

[54] DEVICE TO BE USED AS SPOOL FOR KNITTING YARN AND ALSO AS WEIGHT FOR GIVING TENSION THERETO

[75] Inventor: Fuji Koike, Nagoya, Japan

[73] Assignee: Loyal Kogyo Kabushiki Kaisha, Nagoya, Japan

[21] Appl. No.: 110,913

[22] Filed: Oct. 21, 1987

[30] Foreign Application Priority Data

Nov. 10, 1986 [JP] Japan ..... 61-172350[U]

[51] Int. Cl.[4] ..... B65H 49/00

[52] U.S. Cl. ..... 242/129.72; 242/134; 242/140; 66/125 R

[58] Field of Search ..... 66/125; 242/129.5, .129.51, 242/129.7, 129.71, 134, 136, 140

[56] References Cited

U.S. PATENT DOCUMENTS

| | | | |
|---|---|---|---|
| 363,728 | 5/1887 | Cross | 242/129.53 |
| 366,552 | 7/1887 | Bartholomew | 242/136 |
| 812,670 | 2/1906 | Near | 242/140 |
| 1,293,054 | 2/1919 | Dowdall | 242/129.72 |
| 2,578,045 | 12/1951 | Conrad et al. | 242/129.53 |
| 2,635,832 | 4/1953 | Richmond | 242/140 |
| 2,659,548 | 11/1953 | Morgester | 242/129.53 |
| 2,893,658 | 7/1959 | Giblin et al. | 242/129.53 |
| 4,552,321 | 11/1985 | Raeckelboom | 242/140 |

*Primary Examiner*—Ronald Feldbaum

*Attorney, Agent, or Firm*—Sughrue, Mion, Zinn, Macpeak & Seas

[57] ABSTRACT

A device having a spool around which a knitting yarn is wound and a holder member holding the spool for rotation and having a slot through which a leading portion of said yarn passes through so that when said device is suspended with the leading portion of the yarn engaged with opened hooks of the concerned latch needles of a hand knitting machine for forming Argyle patterns, said spool may be frictionally held without rotating. Thus, when using a necessary number of said devices, it is possible to avoid troublesome drawing up of two or three colors of yarns which often causes tangle of yarns and replacement of weights respectively attached on the yarns as the knitting operation progresses.

5 Claims, 3 Drawing Sheets

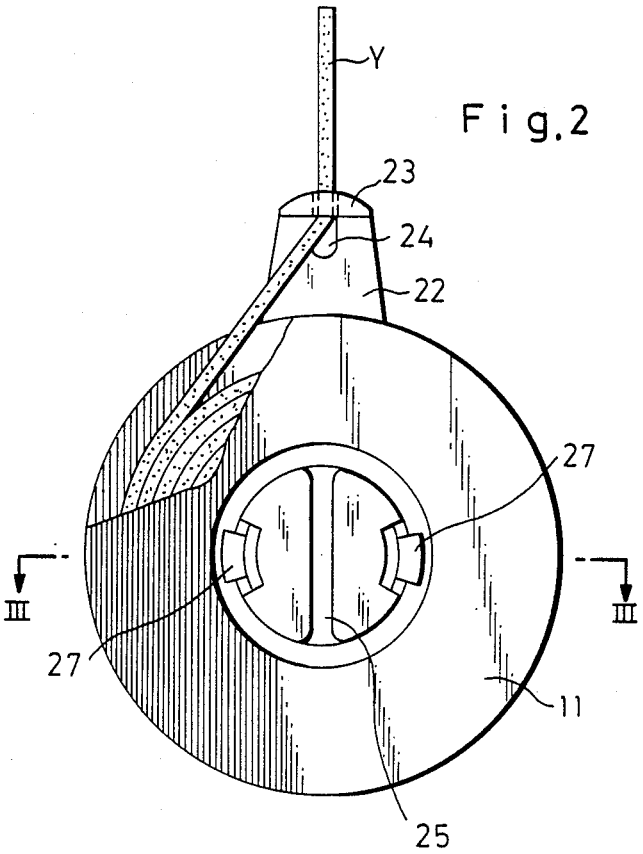
Fig.2
Fig.3
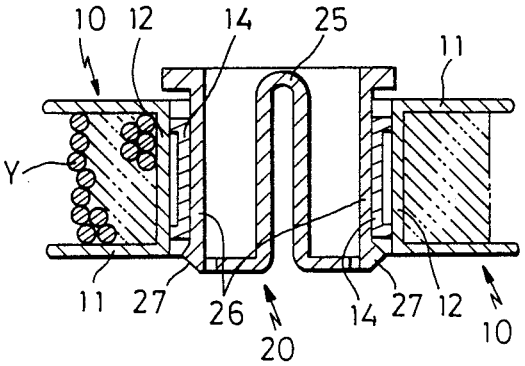

DEVICE TO BE USED AS SPOOL FOR KNITTING YARN AND ALSO AS WEIGHT FOR GIVING TENSION THERETO

TECHNICAL FIELD OF THE INVENTION

The invention relates to a device to be used as a spool for knitting yarn e.g. for Argyle patterns according to the usual hand knitting machine and also as a weight for giving tension to a length of yarn dangling down from the needle bed thereto.

BACKGROUND OF THE INVENTION

There have been proposed various improvements in the hand knitting machine (e.g. U.s. Pat. Nos. 2,043,286, 2,219,607, 3,451,229) which essentially comprises a transversely extended needle bed having a plurality of vertical grooves formed thereon, a plurality of latch needles each arranged in each of said grooves, and a reciprocatingly movable carriage having needle cam channels formed on the underside thereof so that when manually moving said carriage above and along the needle bed, said needles are respectively moved in a wave pattern for knitting operation.

When using such hand knitting machine for forming the so-called Argyle patterns, at least two colors of yarns are engaged with opened hooks of the latch needles brought to the operator's side of the bed. In this case it is preferably to attach a suitable weight on the way of each length of the knitting yarns respectively dangling down from the needle bed. As a matter of course as the knitting operation progresses such weights must be replaced and each of the yarns usually coiled on the floor must be respectively drawn up. Not only is such works troublesome, but also knitting yarns are often tangled to one another during drawing up.

SUMMARY OF THE INVENTION

It is an object of the invention, thus, to avoid and overcome the disadvantages referred to above.

It is a further object of provide a device of simple construction, and consequently inexpensive and easily operable.

Such objects can be attained by the invention to provide a device comprising a spool around which a length of knitting yarn is wound and a holder member holding said spool for rotation and having a slot through which a leading portion of said yarn passes so that when said device is suspended with the free end of said yarn fixed, said spool is frictionally held without rotating.

The invention will be explained in more detail in respect of a preferred embodiment with reference to the accompanying drawings.

DESCRIPTION OF THE DRAWINGS

FIG. 2 is a front elevation view of said device partly cut off, FIG. 3 is a sectional view taken along a line III—III in the direction shown by arrows, in FIG. 2

PREFERRED EMBODIMENT

Figure 1:
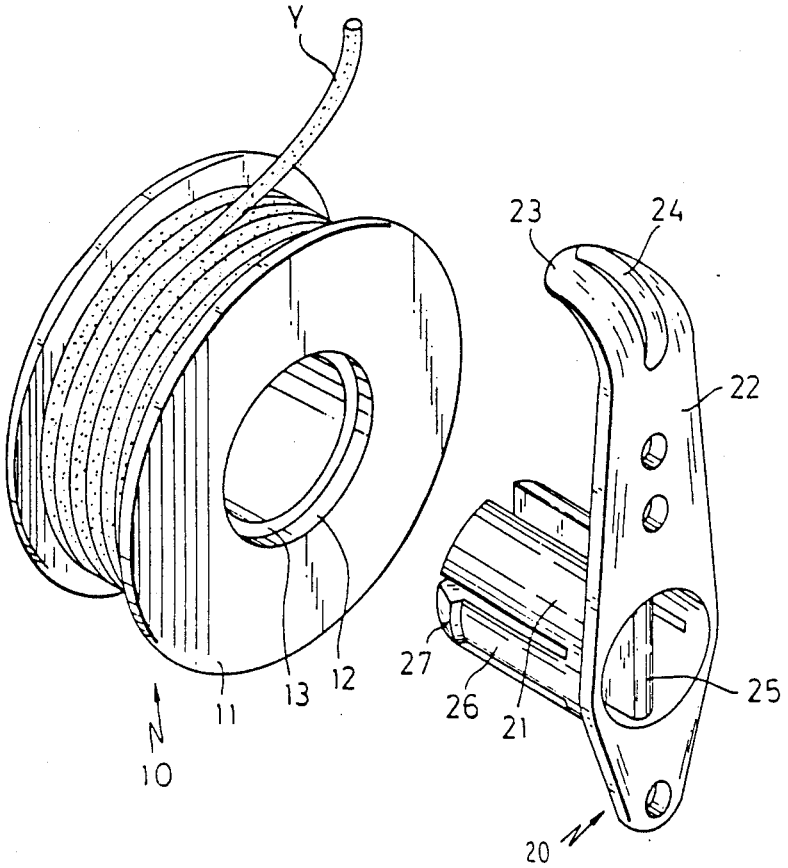
FIG. 1 is an exploded perspective view of the device according to the invention.

The device of the invention comprises two members represented generally by 10 and 20 as best shown in FIG. 1.

The member 10 in the form of a spool comprises a pair of disk flanges 11, 11 oppositely arranged and connected together with a cylindrical wall portion 12 so that a length of knitting yarn Y is wound around said cylindrical portion 12 and between said flanges 11, 11. A central hollow 13 defined by said cylindrical wall 12 is adapted to be fitted with a cylindrical portion 21 of said second member 20 for relative rotation.

It is preferably to arrange a separate collar member 14 between said cylinderical wall 12 and said cylindrical portion 21 as best shown in FIG. 3 for the reason to be referred hereafter.

The holer member 20 has an elongated plate portion 22 extended transversely to the axial direction of said cylindrical portion 21 and formed integratedly therewith. The plate portion 22 has one end 23 curved towards said cylindrical portion 21 and formed with a slot 24 so that when fixing the free end of the knitting yarn Y which extends from the spool 10 mounted on said cylindrical portion 21 for free rotation passing through said slot 24 so that said assembly is suspended with the gravity thereof, said spool is held without rotation due to friction between the yarn Y and the concerned edge of said slot 24.

It is not always necessary but preferably that cylindrical portion 21 and extended plate portion 22 are integrally formed of a thermoplastic polymer as best shown in FIG. 3 in which a central bent portion 25 is only for the purpose of reinforcement of the hollow cylindrical portion. A circular opening through which said bent portion 25 is seen in FIG. 1 is only for convenience of forming said holder member 20 from the thermoplastic polymer.

For the convenience of inserting said cylindrical portion 21 into the hollow 13 of the spool member and preventing the former from slipping out of the latter, there are preferably formed a plurality of (four in the illustrated embodiment) axial slits in the wall of the hollow cylinder portion 21 so as to form a corresponding number of segments, whereby the diameter of the free end of said cylinder 21 may be elastically reduced to be easily inserted in the hollow 13. Each of opposite segments 26, 26 is formed with a radially protruded hook 27 so that when said cylinder 21 is inserted in the hollow 13, said hooks 27 exposed out of the hollow may elastically expand to engage with the concerned edge of said color member 14 as best shown in FIGS. 2 and 3, which also prevents free relative rotation.

Figure 4:
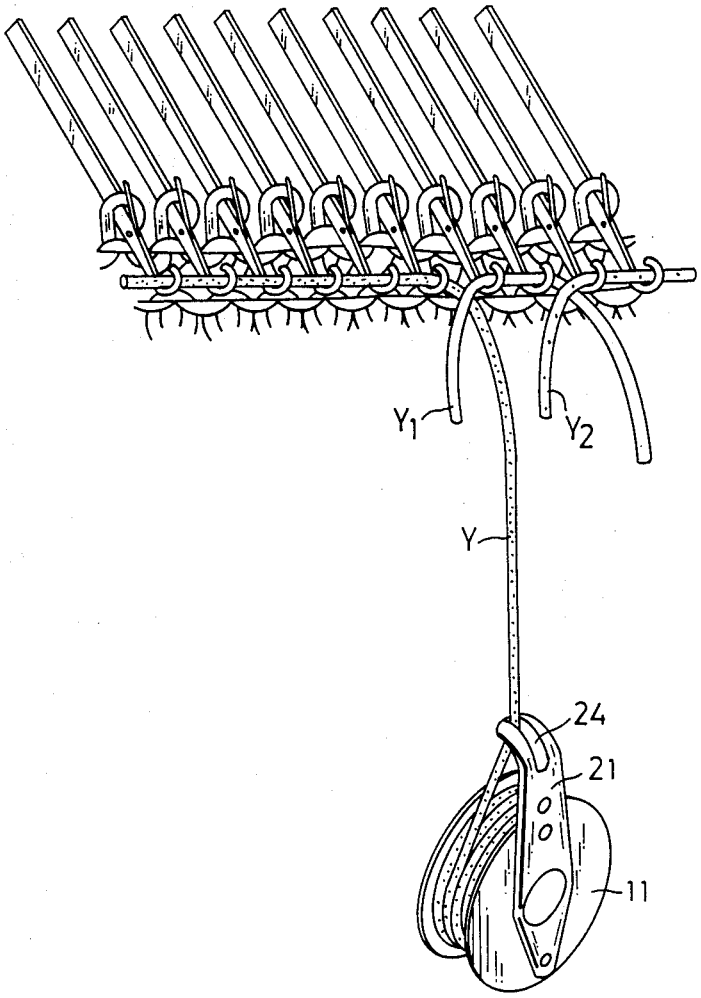
FIG. 4 is a perspective view of said device being in use with relation to the latch needles of the hand knitting machine.

Now in operation with reference to FIG. 4, in which only one device according to the invention is shown for the sake of simplicity of the drawing but since at least two colors of yarns are necessary for forming Argyle patterns as well known and referred to above, the corresponding number of devices are to be used, a necessary length of the knitting yarn Y is drawn up from the spool 10 through the slot 24 and engaged with the opened hooks of the concerned latch needles. Other colors of yarns Y1 and Y2 are also drawn up from the respective devices and engaged with the respectively concerned latch needles. When the hand is released from the device, the yarn Y is suspended in tension with the weight of the device. The spool 10 is not freely rotated now due to friction of the yarn Y with the edge of the slot 24 and of the elastical expansion of the segments 26 with the protrusions 27 with the concerned portions of the spool 10. As the knitting operation progresses the device is to be gradually lifted. It will be obvious that the spool 10 may be manually forcingly rotated relative to the cylindrical portion 21 of the holder so as to release a necessary length of the yarn therefrom

What is claimed is:

1. A device comprising a spool around which a length of knitting yarn is wound and a holder member holding said spool for rotation and having a slot through which a leading portion of said yarn passes so that when said device is suspended with the free end thereof fixed, said spool may be frictionally held without rotating, wherein said holder member is formed with a cylindrical portion and an elongated plate portion which extends transversely to the axial direction of said cylindrical portion and which has the slot formed at one end thereof, said spool has a central hollow in which said cylindrical portion is snugly fitted so as to hold said spool for rotation and so that when a leading portion of said yarn passing through said slot is suspended with the free end thereof, the spool is frictionally held by the holder member without relative rotation, and wherein said cylindrical portion has a plurality of segments, at least one of said segments is provided with a radially outwardly protruded hook at the free end thereof so that when said cylindrical portion is inserted in the central hollow of said spool, said segments are elastically expanded and said protruded hook may prevent the spool from slipping out of said cylindrical portion.

2. The device according to claim 1, in which said cylindrical portion is formed to be hollow and to have a plurality of axial slits and consequently a corresponding number of said segments so that said cylindrical portion may be diameter towards the free end thereof and readily inserted in said central hollow of the spool.

3. A device comprising:

a spool around which a length of knitting yarn is wound; and a holder member for holding said spool for rotation, said holder member having a slot through which a leading portion of the yarn passes so that when the device is suspended with the free end thereof fixed, said spool may be frictionally held without rotating;

wherein said holder member is formed with a cylindrical portion and an elongated plate portion which extends transversely to the axial direction of said cylindrical portion, said cylindrical and elongated plate portions are integrally formed, said elongated plate portion has the slot at one end thereof, and wherein said spool has a central hollow in which said cylindrical portion is snugly fitted so as to hold said spool for rotation and so that when a leading portion of the yarn passing through the slot is suspended with the free end thereof, said spool is frictionally held by said holder member without relative rotation.

4. The device according to claim 3, wherein said cylindrical portion and said elongated plate portion are integrally formed by injection molding.

5. The device according to claim 3, wherein the end of said elongated plate portion having the slot is curved relative to the remaining portion of said elongated plate portion.

* * * * *